United States Patent [19]

Allee

[11] 4,236,263

[45] Dec. 2, 1980

[54] SLEEPING BAG FOR CHILDREN

[76] Inventor: Lannie Allee, 411 East Seminary St., Greencastle, Ind. 46135

[21] Appl. No.: 13,582

[22] Filed: Feb. 21, 1979

[51] Int. Cl.[3] ..... A47G 9/08

[52] U.S. Cl. ..... 5/413; 2/69.5; 46/152; D6/268

[58] Field of Search ..... 5/413, 414, 416, 417, 5/419, 420; 2/69.5; D6/203, 268; D2/35; 46/152, 158

[56] References Cited

U.S. PATENT DOCUMENTS

| | | | |
|---|---|---|---|
| D. 249,437 | 9/1978 | Myers | D6/268 |
| 3,382,504 | 5/1968 | Barbosa | 2/80 |
| 3,579,675 | 5/1971 | Scheer | 5/416 |
| 4,133,064 | 1/1979 | Petrusek | D6/203 |

FOREIGN PATENT DOCUMENTS

| | | | |
|---|---|---|---|
| 2516781 | 10/1976 | Fed. Rep. of Germany | 5/416 |

OTHER PUBLICATIONS

"Little Kid's Sleeping Bag," Model No. 2178-P from p. 45 of the Joan Cook Catalog (1979), 3200 S.E. 14th Ave., Ft. Lauderdale, Fla. 33316.

*Primary Examiner*—Roy D. Frazier
*Assistant Examiner*—Alexander Grosz
*Attorney, Agent, or Firm*—Townsend and Townsend

[57] ABSTRACT

A sleeping bag having an upper side and an under side and an opening at one end is provided with indicia representing a creature, the mouth parts of which are aligned with the open end so that a user entering the sleeping bag at the open end is given the impression of crawling into the mouth and body of the creature to sleep.

6 Claims, 3 Drawing Figures

SLEEPING BAG FOR CHILDREN

BACKGROUND OF THE INVENTION

1. Field of the Invention

This invention relates to sleeping bags with indicia of various creatures placed thereon so as to provide particular appeal for children using the bag.

2. Summary of the Prior Art

Many sleeping bags are known which are designed so that a person can sleep in the bag with his body located between the bag's upper and under sides and his head extending through the opening at the end of the bag. An example of such a sleeping bag, with a frame attached thereto, is disclosed in U.S. Pat. No. 3,842,454. Some sleeping bags have been provided with a padded pillow extending from the underside of the bag at the opening, where indicia representing the head of a cartoon figure are superimposed on the upper pillow surface so as to appeal to children using the bag. Such a sleeping bag is disclosed in U.S. Pat. No. 3,579,675.

Although sleeping bags in general, and those bearing cartoon characters in particular, have great appeal to children, they do not provide a child with the type of provocation to the imagination provided by the invention described herein: the feeling of climbing into the mouth of a creature as if being eaten alive.

It is also known to design costumes to represent animals or other creatures. Some take the form of garments which can be inflated to give the animal its shape and which bear indicia representing certain features of the animal. Such costumes are disclosed in U.S. Pat. No. 3,382,504. Others take the form of an inverted sack with an opening in one side of the sack near its closed end where the head portion of the costume is located so that a child can wear the costume with the bag surrounding his body, his eyes and face aligned with the opening in the side. Such a costume is disclosed in U.S. Pat. No. 3,599,240. Again, none of these costumes provides one with the feeling that he or she is climbing into the jaws of a particular creature.

SUMMARY OF THE INVENTION

The present invention is a sleeping bag with an upper side, an under side and an opening at one end, each side having an inner surface and an outer surface, wherein indicia representing the mouth parts of a creature are superimposed on the outer surface of the upper side of the bag so that the "mouth" of the creature is aligned with the opening in the bag. This combination, the bag and aligned "creature" indicia, provides a particular thrill, and therefore has particular appeal for children; the child is given the impression of being "eaten alive" as he or she enters the bag at the opening. The child then sleeps in what may be considered part of the creature's body with his head extending through the creature's mouth.

Preferably, the sleeping bag is provided with a pillow attached to the underside of the bag at the open end, and a flap attached to the upper side at the open end and covering the pillow. The outer surface of the flap then bears the indicia representing the creature's mouth parts, preferably its entire head, so that the pillow and the flap together form the head and mouth portion of the indicia-represented creature. The flap is usually designed so that it can easily be folded back onto the upper side of the bag out of the way of a sleeper who has entered the bag. The remainder of the bag then preferably bears indicia representing the rest of the body of the creature.

DESCRIPTION OF THE SPECIFIC EMBODIMENTS

The present invention is a sleeping bag having an upper side and an under side with inner and outer surfaces, and provided with an opening at one end, wherein indicia representing the mouth parts of a creature are aligned with the open end so that a user entering the sleeping bag at the open end interacts with the indicia-represented creature by crawling through the mouth and into the body of the creature to sleep.

Figure 1:
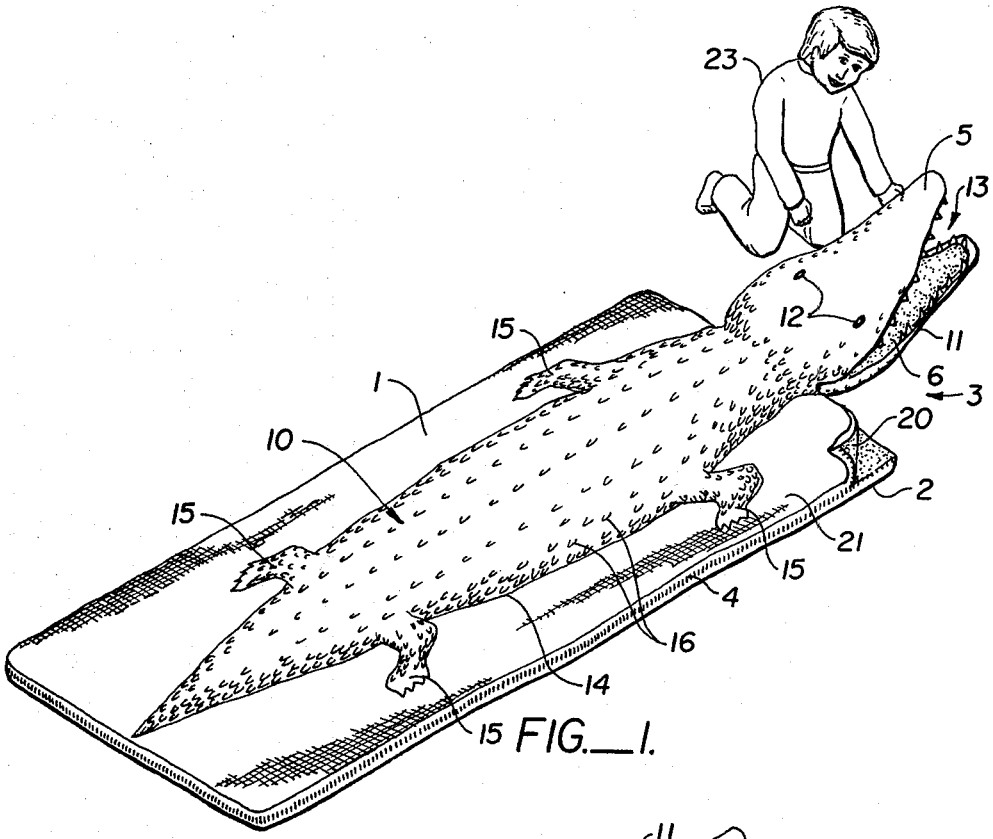
FIG. 1 is a perspective view of the preferred embodiment of the sleeping bag of the present invention illustrating in detail the upper side of the sleeping bag and showing a child about to enter the bag.

Referring to FIG. 1, the preferred embodiment of the present invention can be seen. The invention includes a sleeping bag having an upper side 1 and an under side 2, each side having an inner surface 20 and an outer surface 21. The bag is provided with an opening 3 at one end. The sleeping bag includes a closable opening 4 between the upper and under sides, usually in the form of a zipper beginning at the open end 3 and extending the length of the bag. The upper side 1 of the bag includes a flap 5 at the open end 3 and the under side 2 of the bag includes a pillow 6 at the open end. The pillow and flap have the shape of the head of a creature, here an alligator.

Indicia 10 representing the body of the alligator, are located on the outer surface 21 of the upper side 1 of the bag. The indicia representing the head of the alligator are located on the flap 5 and include indicia representing the mouth parts 11 aligned with the open end so that a child, 23, entering the bag at the open end crawls into the mouth of the indicia-represented creature. The flap 5 particularly includes indicia representing the alligator's eyes, 12, as well as indicia of teeth, 13 located at the periphery of the flap. The outer surface of the upper side of the bag also includes indicia 14 outlining the body of the alligator, 15 representing its legs and feet, and 16 representing its scales.

Figure 3:
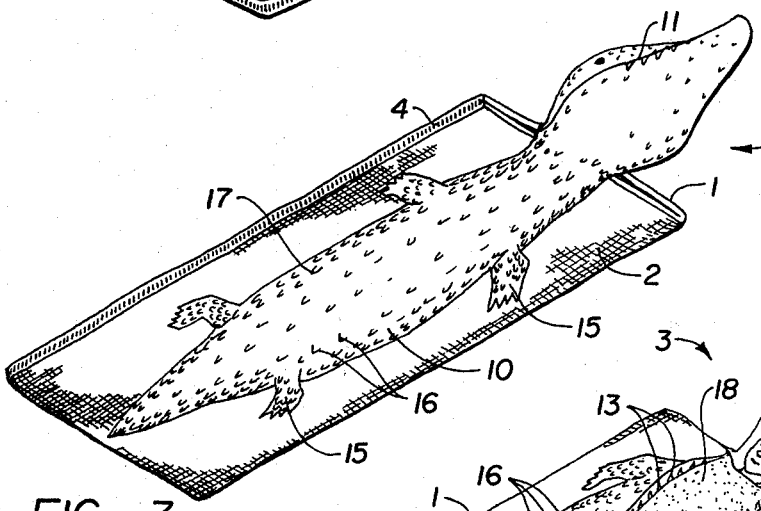
FIG. 3 is a view of the underside of the preferred embodiment of the invention particularly illustrating the indicia located on the underside of the bag.

Referring now to FIG. 3, indicia 17 representing the under side of the alligator are located on the outer surface of the under side 2 of the bag, so that the mouth 11 of the creature is aligned with the open end 3 of the bag. These indicia include indicia 14 outlining the body of the alligator, 15 illustrating its legs and feet, as well as 13, representing its teeth, located at the periphery of the pillow.

Figure 2:
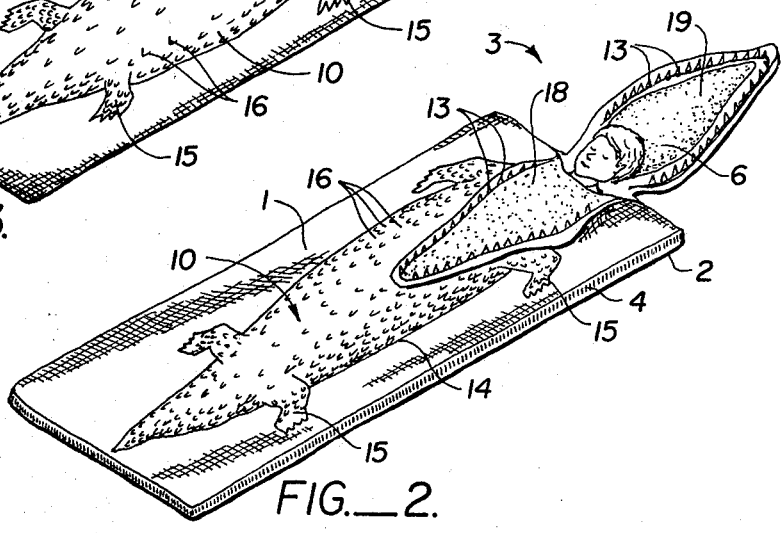
FIG. 2 is a partial perspective view of the preferred embodiment of the invention, illustrating the pillow and the folded-back flap, and showing a child sleeping in the bag.

Referring now to FIG. 2, it can be seen that the flap 5 can be folded back onto the upper side of the bag. As illustrated in FIG. 2 the inner surfaces of the pillow 6 and flap 5 also bear indicia 18 representing the inside of the alligator's mouth. These include indicia 13 representing teeth, and indicia 19 representing a tongue.

Consequently, the sleeping bag in combination with the indicia aligned with the open end and representing the creature's mouth parts provides great appeal for children in that a child entering the bag can actually "interact" with the creature by crawling into the creature's mouth, as if being eaten alive. The child then can sleep in the bag with his head resting upon the pillow and extending into the creature's "mouth" and his body resting in the body of the creature as shown in FIG. 2.

It will be understood that the above description and the drawings are intended by way of illustration and not by way of limitation, and that many variations can be made within the scope of the invention which is defined by the appended claims.

What is claimed is:

1. A sleeping bag having an upper side and an under side, each with an inner and outer surface, said bag being provided with an opening at one end, said underside including a pillow at the open end of the bag and said upperside including a flap at the open end of the bag, said flap being foldable back onto the upper side, said bag bearing indicia representing the body of a creature, and the pillow and the flap cooperating together to form the head of said creature, the indicia representing the mouth parts and teeth of the creature being located on the flap and pillow and aligned with the open end of the bag, so that a user entering the bag through the open end crawls past the teeth into the mouth of the indicia-represented creature.

2. A sleeping bag according to claim 1 wherein a closable opening is provided between the upper side and the under side of the bag, said closable opening extending from the open end of the bag at least part of the length of the bag.

3. A sleeping bag according to claim 1 wherein the animal is an alligator.

4. A sleeping bag according to claim 1 wherein said flap and pillow each have an upper and a lower surface and the lower surface of said flap and upper surface of said pillow bear indicia representing the inside mouth portions of the creature.

5. A sleeping bag according to claim 4 wherein the indicia representing teeth are located at the periphery of the open end of the lower surface of said flap and upper surface of said pillow.

6. A sleeping bag of generally rectangular shape having an upper side and an under side, each with an inner and outer surface, said bag being provided with an opening at one end and a closable opening between the two sides, said closable opening extending from said open end of the bag at least part of the length of said bag, said underside including a narrower elongated pillow at the open end of said bag, and said upper side including a narrower elongated flap at the open end of the bag, said flap being foldable back onto the upper side, said bag bearing indicia representing the body of an alligator, wherein said flap and pillow cooperate to form the head of said alligator and the inner and outer surfaces of said sizes bear the indicia representing said alligator, the indicia representing the mouth parts and teeth of the alligator located on the flap and the pillow and aligned with the open end of the bag so that a user entering the bag through the open end crawls past the teeth into the mouth of the indicia-represented alligator.

* * * * *